US007122741B2

(12) United States Patent
Gossman

(10) Patent No.: US 7,122,741 B2
(45) Date of Patent: Oct. 17, 2006

(54) CONTACT SCREW

(75) Inventor: Christian Gossman, Habsheim (FR)

(73) Assignee: Woertz AG, Muttenz (CH)

( * ) Notice: Subject to any disclaimer, the term of this patent is extended or adjusted under 35 U.S.C. 154(b) by 0 days.

(21) Appl. No.: 10/533,588

(22) PCT Filed: Nov. 4, 2002

(86) PCT No.: PCT/CH02/00593

§ 371 (c)(1),
(2), (4) Date: May 3, 2005

(87) PCT Pub. No.: WO2004/042872

PCT Pub. Date: May 21, 2004

(65) Prior Publication Data

US 2006/0060373 A1 Mar. 23, 2006

(51) Int. Cl.
*H01R 4/24* (2006.01)

(52) U.S. Cl. ..... 174/87; 439/415

(58) Field of Classification Search ..... 174/87, 174/94 R; 439/415, 416
See application file for complete search history.

(56) References Cited

U.S. PATENT DOCUMENTS 2,097,426 A 11/1937 Arthur et al.
3,848,955 A 11/1974 Lockie et al.
5,131,283 A * 7/1992 Canfield ..... 73/864.74
6,027,367 A 2/2000 Woertz et al.

FOREIGN PATENT DOCUMENTS

DE 3340943 A1 5/1985

* cited by examiner

*Primary Examiner*—Chau Nguyen N.
(74) *Attorney, Agent, or Firm*—Breiner & Breiner, L.L.C.

(57) ABSTRACT

A contact screw for conductive cores of a shielded cable, said screw being provided to be moved axially in a connecting device by threading; it has a shank with screw threading and a contact tip the section of which provided for penetration of the cable insulation and the shield is provided with a coating of insulating material, the exterior surface of the coating being provided with threading whose pitch is greater than the pitch of the screw threading of the shank.

4 Claims, 2 Drawing Sheets

Threading 3 = Pitch P1
Threading 5 = Pitch P2
wherein
P2 > P1

Threading 3 = Pitch P1
Threading 5 = Pitch P2
wherein
P2 > P1

CONTACT SCREW

FIELD OF INVENTION

The present invention relates to a contact screw for conductive cores of a shielded cable, in particular the data transmission cores of a flat cable having a plurality of conductive cores, such screw being provided to be moved axially by means of threading in a connection device and having a shank with screw threading and a contact tip, the section of the contact tip provided for penetration of the cable insulation being provided with a coating of insulating material.

BACKGROUND OF INVENTION

The problem, particularly in the case of flat cables that have energy transmission and data transmission cores, lies in piercing the data conductor in the shielded cable without the screw coming in contact with the shield (electrically conductive material), while in the process achieving good contact resistance between the end of the contact tip and the conductor and retaining high dielectric strength between shield and conductor.

In the past this object has been attained by means of a contact screw with an end casing of hard insulating material which extends through the cable jacket, the shield, and the core insulation when the conductor is pierced. One disadvantage of this solution is that the force of penetration is transmitted to the insulating material and the shield is drawn toward the conductor, something which disadvantageously reduces the distance between shield and conductor.

OBJECTS AND BRIEF DESCRIPTION OF INVENTION

The object of this invention is to eliminate the disadvantages indicated in the foregoing of a contact screw as defined above.

It is claimed for the invention that this object has been attained for a contact screw of the type indicated by means of the features specified in the claims.

In comparison with the state of the art, a higher dielectric strength between shield and conductor is achieved and the force of penetration of the metal component of the screw is transmitted by the metal component rather than by the insulating material. This solution also makes it possible to achieve a larger contact surface between screw (tip end) and conductor.

Especially advantageous embodiments of the object of the invention are specified in the dependent claims.

BRIEF DESCRIPTION OF DRAWINGS

The invention is described in somewhat greater detail in what follows with reference to the drawing, in which.

DETAILED DESCRIPTION OF THE INVENTION

Figure 1:
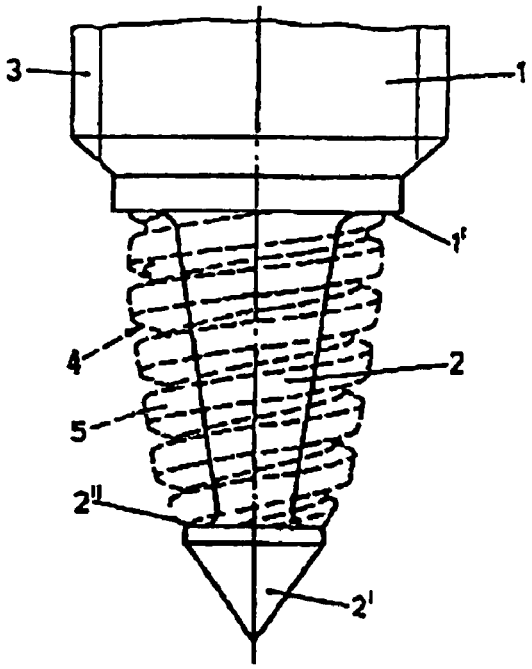
FIG. 1 presents a side view of the contact tip end of a contact screw claimed for the invention.
Figure 2:
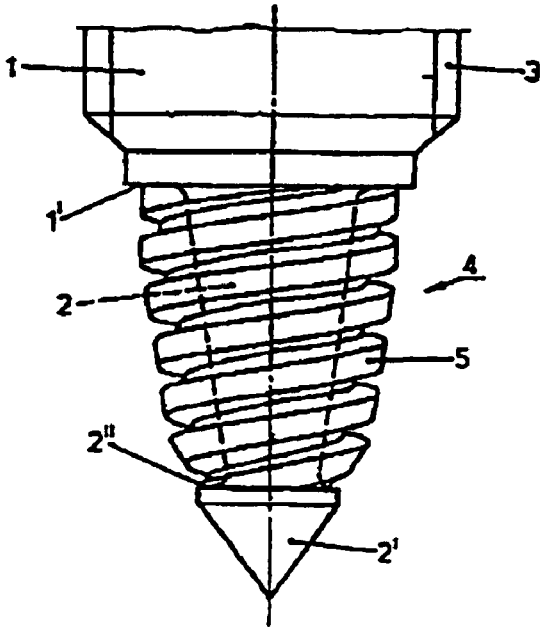
FIG. 2 is a view similar to that of FIG. 1 with insulating casing mounted.

The drawing (FIGS. 1 and 2) shows the lower part of a contact screw of metal with shank 1 and contact tip 2 with mushroom-shaped end 2'. A screw threading 3 of predetermined pitch (for example 0.7) is provided on the shank 1. The screw may be moved axially by way of the screw threading 3 in a tapped hole of a connecting device (not shown).

A casing 4 of insulating material is mounted in the section of screw between the end of the shank and the end of the contact tip 2. The casing 4 tapers, as does the contact tip 2, to the conical end 2', being positioned between the shoulders 1' of the end of the shank and 2" of the mushroom-shaped end 2'.

A threading 5, a double helix if desired, the pitch of which is greater than that of the screw threading 3 (for example 1.2 mm as opposed to 0.7 mm) is provided on the outer surface of the casing 4.

Since the screw threading 3 determines the movement of the screw, relative movement results in the area of the threading 5 of the casing 4 which draws the insulation of the conductor upward (that is, away from the conductor) and so increases the distance between shield and conductor when the contact screw is screwed in.

The pressure between the flanks of the contact tip 2 of the screw and the insulating material of the cable is increased and accordingly the electric strength is further improved by the tapered shape of the insulating casing 4.

The mushroom-like shape of the end 2' of the contact tip 2 protects the insulating casing 4, as a result of which the force of penetration is now transmitted by the metal component rather than by the insulating casing.

Figure 3:
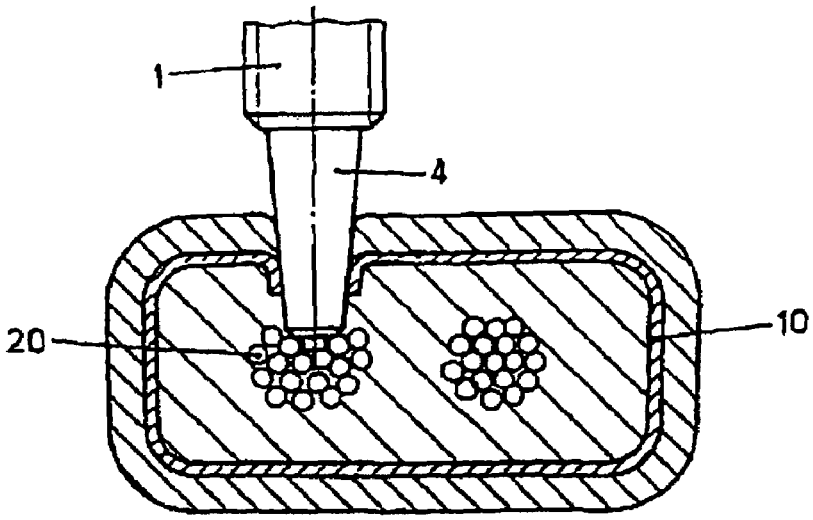
FIGS. 3 and 4 are diagrams of the mode of operation of contact screws.

FIG. 3 of the drawing presents a purely diagrammatic view of a contact screw of the state of the art. It is clearly to be seen that the shield 10 is pressed closer to the conductor 20 at the point of penetration.

Figure 4:
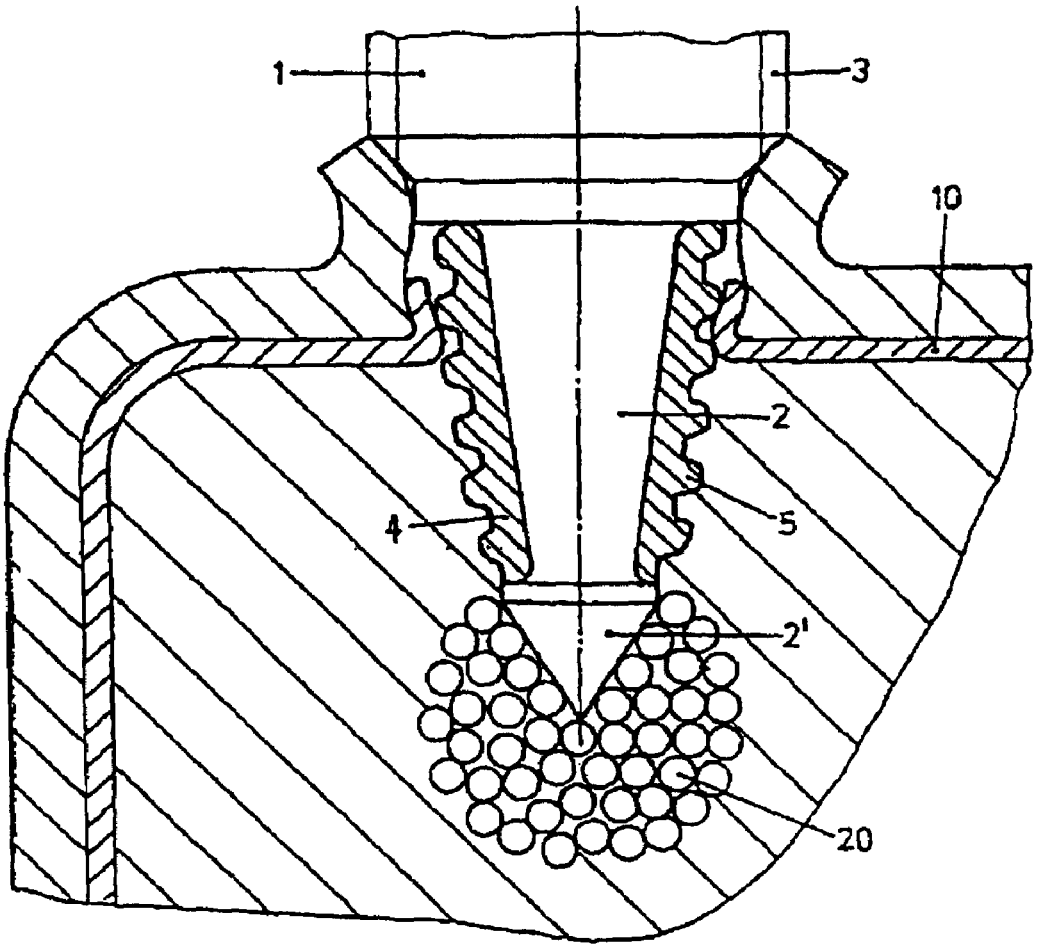

FIG. 4 illustrates the solution claimed for the invention. It is clearly to be seen how on the insulated casing 4 both the insulation and the shield 10 are at the point of penetration moved away from the conductor 20 because the exterior threading 5 is of a pitch greater than that of the screw threading 3.

The invention of claimed is:

1. A contact screw for conductive cores of a shielded cable comprising a shank with screw threading and a contact tip, wherein a section of the contact tip provided for penetrating cable insulation has a coating of insulating material, and an exterior surface of the coating includes threading having a pitch which is greater than a pitch of the screw threading on the shank, wherein the screw is constructed and arranged to move axially in a connecting device due to said threading on the shank, wherein the contact tip and the coating are configured to taper toward the end of the screw.

2. The contact screw as claimed in claim 1, wherein the end of the contact tip is conically-shaped and the coating is positioned between the shank and a shoulder of said end.

3. A contact screw for conductive cores of a shielded cable comprising a shank with screw threading and a contact tip, wherein a section of the contact tip provided for penetrating cable insulation has a coating of insulating material, and an exterior surface of the coating includes threading having a pitch which is greater than a pitch of the screw threading on the shank, wherein the screw is constructed and arranged to move axially in a connecting device due to said threading on the shank, wherein the pitch of the threading on the exterior surface of the coating is at least twice the pitch of the screw threading on the shank.

4. The contact screw as claimed in claim 3, wherein the end of the contact tip is conically-shaped and the coating is positioned between the shank and a shoulder of said end.

* * * * *